United States Patent [19]

Sabella

[11] 4,067,287

[45] Jan. 10, 1978

[54] ANCHOR FLOAT ADAPTER

[76] Inventor: Dominick A. Sabella, 84 Adams St., East Rockaway, N.Y. 11518

[21] Appl. No.: 744,503

[22] Filed: Nov. 24, 1976

[51] Int. Cl.[2] ..... B63B 21/46

[52] U.S. Cl. ..... 114/299; 43/17.2

[58] Field of Search ..... 114/221 R, 293, 294, 114/297, 299, 52; 43/17.2, 44.97

[56] References Cited

U.S. PATENT DOCUMENTS

| | | | |
|---|---|---|---|
| 1,323,249 | 12/1919 | Cowles | 114/52 |
| 2,597,229 | 5/1952 | Cox | 43/17.2 |
| 2,714,777 | 8/1955 | Peak | 43/17.2 |
| 2,722,077 | 11/1955 | Newman | 43/17.2 |
| 2,887,814 | 5/1959 | Chambers | 43/17.2 |
| 3,094,095 | 6/1963 | Litchfield et al. | 114/297 |
| 3,769,928 | 11/1973 | Kahl | 114/221 R |
| 3,913,514 | 10/1975 | Reynolds | 114/297 |

FOREIGN PATENT DOCUMENTS

| | | | |
|---|---|---|---|
| 787,621 | 6/1968 | Canada | 43/17.2 |

*Primary Examiner*—Trygve M. Blix
*Assistant Examiner*—Stuart M. Goldstein
*Attorney, Agent, or Firm*—Bauer, Amer & King

[57] ABSTRACT

An anchor raising device and method of raising an anchor in which the device has a tubular body that is readily opened and closed so it may be applied quickly and easily to an anchor line when it is necessary to raise the anchor on the anchor line and is able to be readily removed from the anchor line once the anchor is raised and its purpose has been accomplished.

15 Claims, 12 Drawing Figures

FLOAT

ANCHOR FLOAT ADAPTER

BACKGROUND OF THE INVENTION

1. Field of the Invention

This invention relates generally to a novel method of raising a boat anchor from a submerged, anchored position to a position below the water level that permits easy retrieval. This invention more particularly relates to novel apparatuses that are adapted to perform the method comprising the present invention.

2. Description of the Prior Art

There are many instances wherein it is necessary to pull an anchor up rapidly. The most obvious situation would of course be an emergency. For one reason or another it may be necessary to move the boat rapidly from one position to another. When the boat is used for fishing, it may also be necessary to raise the anchor rapidly when a school of fish is sighted at some location other than where the boat is anchored or when it is important to have the boat move with a hooked fish. In each instance, speed is of the essence. However, mitigating against the use of speed is the possibility of the anchor being wedged or fouled in the bottom of the water as well as the weight of the anchor and of the anchor line. The extent of the problem can be fully appreciated when it is realized that perhaps several hundred feet of anchor line must be pulled in either by hand or by a winch. Frequently when a winch is not available, it takes a considerable length of time and a concerted effort by a number of deck hands to raise the anchor and even when a winch is used, it operates too slowly to lift the anchor quickly.

Several proposals have been made for providing means for raising an anchor. One shortcoming common to the prior art proposals is the need for permanently placing some form of apparatus about the anchor line. While the prior art devices can lift an anchor, it will be evident that the permanent disposition of the device about the anchor line can be disadvantageous. The device can interfere with the personnel who are lifting the anchor and the anchor line and, in addition, can cause the anchor line to become fouled. Still another shortcoming of much of the prior art in this general field is the need for a separate service line that must be towed by a workboat. It will be evident that the use of an additional service line is somewhat more expensive and, in addition, increases the possibility of fouling the line in the propeller of the boat when the boat is being maneuvered.

A typical form of prior art referred to hereinabove is disclosed in U.S. Pat. No. 3,922,990 granted on Dec. 2, 1975, to E. Menard, Jr. The patented structure includes a generally cylindrical, water-tight container. The bottom of the container is closed and the top of the container is concave. A square tube passes axially through the container and receives the anchor line therein. When an anchor is to be raised, the device, which is always on the anchor line, is put over the side and the engine is started. The boat is then run upstream so that the anchor line is pulled through the square tubing. The buoyancy of the container suspends the raised anchor for subsequent retrieval. As pointed out hereinabove, the primary deficiency of the Menard, Jr. structure is the need for permanently placing the device on the anchor line.

U.S. Pat. No. 3,931,782 granted on Jan. 13, 1976, to M. A. Childers, et al, discloses a method for retrieving an anchor. A service line having a submerged, remote-operated catch hook is towed in a direction intersecting the mooring line. When the movable catch engages the mooring line, the catch moves away from its normally closed position and thereby allows the hook to capture the mooring line. After the hook slides down along the mooring line, a pull is exerted on the service line to unseat the anchor. The catch is then remotely operated to free the mooring line from the hook. As mentioned hereinabove, one of the shortcomings inherent in the foregoing method is the need for a separate service line.

Another method for retrieving an anchor buried in the sea bottom and attached by a long mooring line to a floating, moored structure is disclosed in U.S. Pat. No. 3,929,087 granted on Dec. 30, 1975, to T. M. Montgomery. The method described in this issued patent requires that a submerged hook be towed with a service line in a direction that intersects the mooring line at a point between the floating structure and the anchor until the hook catches the mooring line. The service line is then swerved away from the structure in the direction of the mooring line while the hook slides down on the mooring line until the hook arrives at or near the anchor. An upwardly directed force is then applied to the service line in order to unseat the anchor from the sea bottom and then the service line is then gradually reeled in during the anchor retrieval process. Once again, the method described in the Montgomery patent requires the use of a separate service line.

U.S. Pat. No. 3,927,636 granted on Dec. 23, 1975, to M. A. Childers et al, discloses still another method for retrieving an anchor buried in the sea bottom and attached by a long mooring line to a floating, moored structure. In the second Childers patent, a submerged, remotely-releasable hook having a yieldable catch is towed with a service line in a direction that intersects the mooring line at a point between the floating structure and the anchor until the hook catches the mooring line. The catch is arranged to automatically open in order to allow the hook to capture the mooring line. The boat is then maneuvered so that the service line is moved in the direction of the mooring line whereby the hook slides down on the mooring line until the hook arrives at or near the anchor. The service line is then pulled up to unseat the anchor and the hook catch is remotely operated to release the mooring line from the hook. As pointed out hereinabove in connection with the previously discussed methods disclosed by the prior art, a separate service line is required in order to practice the patented method.

In U.S. Pat. No. 3,913,514 issued to L. A. Reynolds on Oct. 21, 1975, there is disclosed an apparatus and a system for retrieving a deployed boat anchor. A buoyant structure is slidably attached to the anchor line by means of a snap fastener while the anchor line is slack. The boat is then moved away from the buoyant structure to take up the slack in the anchor line. When the anchor line is taut, the floating, buoyant structure serves to redirect the downward pulling force generated by the motion of the boat. As the boat is moved further from the buoyant structure, the anchor is raised. The Reynolds patent also requires that a one-way hook be permanently installed on a portion of the anchor line near the anchor in order to prevent the anchor from sinking when the boat is no longer pulling on the anchor line.

U.S. Pat. No. 3,809,001 granted on May 7, 1974, to A. Shute discloses a device for freeing a fouled anchor. In the Shute structure a cylindrical recovery sleeve is permanently installed on the anchor line and is used in conjunction with a separate lifting line. One embodiment of the Shute structure requires that the recovery sleeve be threaded onto the anchor line. Obviously, because one end of the anchor line is secured to the boat and must be undone before the recovery sleeve can be threaded thereon, this structure precludes the rapid application and removal of the recovery sleeve. In an alternative embodiment of the Shute structure, the recovery sleeve is fabricated in two complementary halves which are secured together by bolts and nuts. This structure also precludes the rapid application and removal of the recovery sleeve from the anchor line.

DESCRIPTION OF THE INVENTION

The present invention provides an apparatus and a method for raising an anchor, both of which overcome inherent shortcomings in the prior art. In one broad aspect, the apparatus comprising the present invention includes an elongate tubular body portion having first and second sections that are coupled to each other, such as by a hinge or the like, so that the device may be readily placed about and removed from an anchor line while the boat is anchored or moving and without separating the anchor line from the boat. The body portion is freely movable in only a first or one direction towards the anchor. Clamp or one-way operable wedging means that is coupled to the body portion selectively locks the device at different locations along the anchor line. The clamp means may be in the form of a flapper or wedging plate that is pivotally mounted on the body portion so that one end of the flapper plate wedges against the anchor line and thereby prevents the movement of the body portion in a direction away from the anchor. A float or buoyant element is coupled to the body portion for the buoyant support thereof. Since the float buoyantly supports the anchor line, the body portion will slide down the anchor line until it reaches a position adjacent the anchor and will be locked or wedged in place thereat. The anchor may then be readily lifted at which time the inventive adapter may be removed from the anchor line.

In order to provide maximum holding power and to accommodate anchor lines of different diameters, the edge of the flapper plate that engages the anchor line is curved. In addition, the surface of the flapper plate that faces in the direction of the anchor may also be concave in order to aid in this function. To permit maximum displacement of the flapper plate when a relatively large diameter anchor line is involved, the side edges of the flapper plate are recessed to avoid interference with the adapter body.

The present invention also contemplates the use of a latch for releasably holding the two sections of the body portion together when the body portion is placed about the anchor line. In one form of the present invention, the latch is in the shape of a hairpin-type clip while in another form of the present invention, the latch is comprised of a safety pin-type clip that is U-shaped in construction so that one leg of the clip passes through interdigitated eyes or loops formed on the two sections of the body portion.

The method comprising the present invention includes the steps of loosely applying a buoyantly supported tubular member about an anchor line. The boat to which the anchor line is attached is then moved at an angle, for example, 45°, with respect to the angled portion of the anchor, thereby causing the anchor to turn in its anchored position and release its hook from the bottom of the water and also causing at least a portion of the anchor line to float upwardly due to the buoyant force applied thereto. The tubular body member is thereby allowed to slide freely along the anchor line in a direction towards the anchor and is ultimately clamped or wedged automatically by a flapper plate or the like at a position on the anchor line that is proximate the anchor. This will cause the anchor and the anchor line to float upwardly. The body member may then be removed from the anchor line after the anchor has been retrieved. A further step in the method comprising the present invention requires the transferring of the anchor line from the bow of the boat to the stern of the boat before moving the boat at an angle with respect to the angled portion of the anchor.

Accordingly, it is an object of the present invention to provide improved apparatus for lifting an anchor.

Another object of the present invention is to provide improved anchor lifting apparatus, as described above, that may be readily applied to and removed from an anchor line.

Still another object of the present invention is to provide an improved anchor lifting apparatus, as described above, wherein means are provided for permitting free movement of the anchor lifting device along the anchor line in the direction of the anchor.

Yet another object of the present invention is to provide an improved anchor lifting device, as described above, that is buoyantly supported and which does not rely upon a separate service line.

Still another object of the present invention is to provide an improved anchor lifting device, as described above, wherein latch means are included for retaining two hingedly coupled sections of a body portion to each other and about the anchor line in order to facilitate the retrieval thereof.

A particular object of the present invention is to provide an improved anchor lifting device, as described above, wherein a flapper plate is pivotally mounted on a tubular body portion that encircles the anchor line and wherein the flapper plate permits movement of the tubular body portion in a single direction towards the anchor.

A specific object of the present invention is to provide an improved anchor lifting device, as described above that does not require permanent placement on the anchor line.

A further object of the present invention is to provide an improved method for lifting an anchor.

Still another object of the present invention is to provide an improved anchor lifting method, as described above, wherein a buoyantly supported body portion is removably placed about an anchor line and is allowed to slide freely therealong in the direction of the anchor with the body portion being successively clamped automatically at various locations along the length of the anchor line until the body portion is ultimately clamped on the anchor line closely adjacent the anchor and after the anchor is lifted to a secure position, the body may be removed therefrom.

The above description, as well as further objects, features and advantages of the present invention, will be more fully appreciated by reference to the following detailed description of the presently preferred, but nonetheless illustrative, embodiment in accordance with the present invention when taken in conjunction with the accompanying drawings.

BRIEF DESCRIPTION OF THE DRAWINGS

In the drawings, wherein the same reference numeral denotes the same element throughout the several views.

DESCRIPTION OF THE PREFERRED EMBODIMENTS

Figures 1, 2, 3, 4, 5, 6, 7, 8, 9, 10, 11, 12:
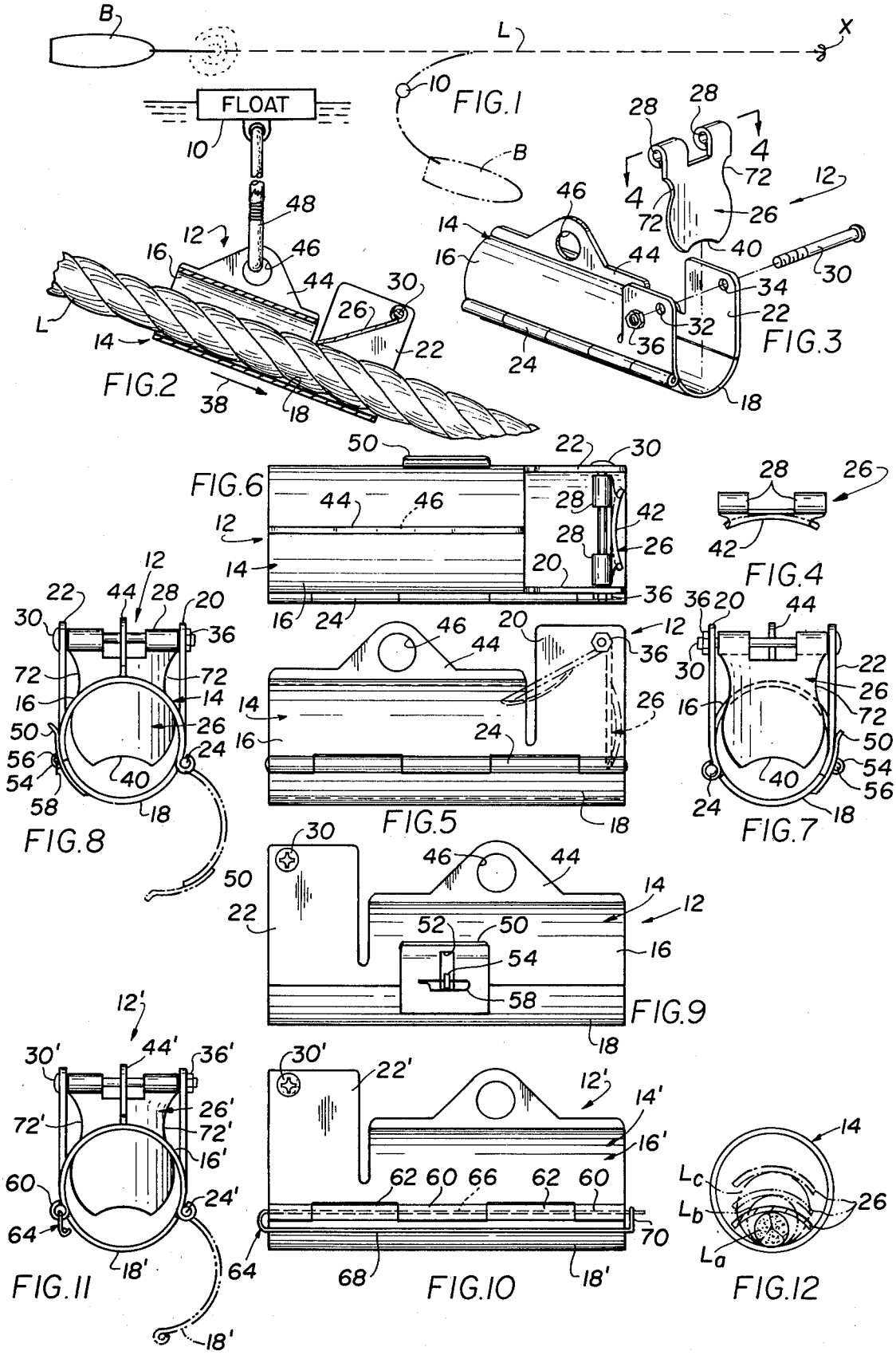
FIG. 1 is a schematic view illustrating a particular step in maneuvering the boat during the practice of the method comprising the present invention.
FIG. 2 is a fragmentary elevational view, partially in section, schematically illustrating the structure comprising one particular embodiment of the present invention.
FIG. 3 is an exploded view illustrating a portion of the structure comprising the present invention.
FIG. 4 is a plan view taken along line 4—4 of FIG. 3.
FIG. 5 is a side elevational view of a portion of the structure comprising the present invention.
FIG. 6 is a plan view of the structure shown in FIG. 5.
FIG. 7 is an end elevational view of the right hand side of the structure shown in FIG. 5.
FIG. 8 is an elevational view of the opposite side of the structure shown in FIG. 5 with a portion shown in phantom outline indicating the open position of the apparatus comprising the present invention.
FIG. 9 is an elevational view illustrating the opposite side of the structure shown in FIG. 5.
FIG. 10 is a side elevational view of an alternative embodiment of the present invention.
FIG. 11 is an end elevational view of the structure shown in FIG. 10 with a portion thereof shown in phantom outline indicating the open condition of the apparatus.
FIG. 12 is a schematic, end elevational view illustrating the applicability of the present invention to anchor lines of various diameters.

Referring now to the drawings, there is shown in FIG. 1 a maneuver that is made by a boat B in order to free an anchor X in accordance with the method comprising the present invention. An anchor line L is secured in any conventional manner to the bow of the boat B with the anchor line L, which may be rope, secured to the anchor at the position marked X. As will be described more fully hereinafter, a float 10 is buoyantly supported in the water and the adapter 12 comprising the present invention is secured thereto. The adapter 12 is also mounted on the anchor line L as shown in FIG. 2. The anchor line is first moved to the stern of the boat B as shown in phantom outline in FIG. 1 and then the boat is moved at an angle of approximately 45° with respect to the angled position of the anchor. This causes anchor X to turn and release its wedge or hook at the ocean bottom. Thereafter, the boat is continued in its movement through an arc of approximately 180° as shown in FIG. 1. As it moves at an angle to the position of the anchor X, the anchor line L rises because it becomes slack and of the buoyant effect of the float 10 acting on its slack length. As the anchor line L rises, the float adapter 12, being buoyed or lifted by the float 10 attached thereto rides down along the rising anchor line L to lift the anchor line L upward. The method comprising the present invention also includes the steps of selectively clamping or wedging the adapter 12 at various locations along the anchor line 11 until the adapter 12 is finally clamped to the anchor line L in close proximity to the anchor.

The structure for carrying out the method comprising the present invention is best illustrated in FIGS. 2–9. As shown therein, the adapter 12 is comprised of an elongate essentially hollow body portion 14 that includes two sections 16 and 18. Together the two sections 16 and 18 define the enclosing elongated, generally tubular essentially hollow body portion 14, at one end of which there is provided a pair of laterally opposed tabs 20 and 22. The section 18 is pivotally secured to the section 16 by means of an axially extending hinge 24 to open and close an elongate opening in the body section 16 through which the anchor line L is inserted into and removed from the body.

The tabs 20 and 22 are utilized for mounting a flapper or wedge plate that is generally designated by the reference character 26. The flapper plate 26 has loop 28 formed at one end thereof for receiving a pivot pin 30 that also passes through apertures 32 and 34 formed, respectively, in the tabs 20 and 22. The pivot pin 30 may be retained by means of a nut 36.

As shown best in FIG. 2, the flapper plate 26 is loosely positioned above the anchor line L so that the adapter 12 may slide freely therealong but only in the direction of the anchor X as designated by the arrow 38 in FIG. 2. The flapper plate 26 will normally prevent movement of the adapter 12 in the opposite direction. However, in order to maximize the clamping effect of the flapper plate 26, the lower edge 40 thereof is formed with a concave recess. As shown in FIG. 4, the lengthwise extent of surface 42 of the flapper plate 26 that faces in the direction of the anchor is also concave in order to provide maximum contact between the flapper plate 26 and the anchor line L.

In the embodiment illustrated, a rib 44 is formed integrally with the section 16 of the body 14 and is provided with an opening 46 therein. A line 48 is passed through the opening 46 and is secured to the float 10 in order to buoyantly support the adapter 12.

As shown best in FIGS. 5, 7 and 8, the section 18, which is hingedly secured to the section 16 by means of the hinge 24, may be opened as shown by the phantom outline in FIG. 8 to expose the anchor line exit and entrance opening of the section 16. The section 16 includes a latch plate 50 having a slot 52 therein. An eye 54 having an opening 56 therein is rigidly secured to the section 16 of the body portion 14. As shown in FIG. 9, a U-shaped, hairpin-type spring clip 58 may be passed through the opening 56 in the eye 54 in order to retain the section 18 in the closed position such as shown in FIG. 7, for example.

The embodiment of the present invention, as shown in FIGS. 10 and 11, differs from the first embodiment described hereinabove only in that a different latching mechanism is used. As shown in FIG. 10, a plurality of interdigitated loops 60 and 62 are formed integrally with the sections 16′ and 18′ of the adapter 12′, respectively. A U-shaped safety pin-type clip 64 is used instead of the hairpin-type clip 58 described in connection with the first embodiment. A first leg 66 of the clip 64 passes through the interdigitated loops 60 and 62 while a second leg 68 of the clip 64 is external of the adapter 12′ and is parallel to the first leg 66. One of the legs, for example the leg 68, is formed with a clasp 70 that releasably engages the other leg 66.

Both of the embodiments of the present invention are utilized in exactly the same manner. For purposes of simplicity only, the manner of mounting the structure shown in the first embodiment will be described. When it is desired to lift the anchor, the second section 18 of the body portion 12 is angularly displaced about the hinge 24 from its solid line position where it closes the opening of section 16 to the phantom outline position shown in FIG. 8 where it opens the opening of section 16. The adapter 12 is then mounted on the anchor line L as shown in FIG. 2 by inserting the line into the body section 16 through its opening with the flapper plate 26 resting on the anchor line L. After maneuvering the boat B as described in connection with FIG. 1 to loosen the anchor's engagement with the bottom surface, the adapter 12 will slide freely down the slack anchor line L and, since the adapter 12 is buoyantly supported by means of the float 10 that is coupled thereto by the line 48, the anchor line L and the anchor X will start to float upwardly. The adapter 12 will continue its movement along the anchor line L toward the anchor X until it reaches the anchor and it will clamp to the line L at its final position adjacent the anchor at the wedge plate 26. It will be appreciated that the wedge plate 26 automatically clamps and unclamps against the anchor line L as it moves down along and as the anchor line L is raised by the buoyant effect of the float 10. Once the anchor is retrieved, the adapter 12 may be readily removed from the anchor line L merely by removing the spring clip 58 and angularly displacing the section 18 to the position shown in phantom outline in FIG. 8 to open the elongate opening in the body section 16 through which it is removed.

The applicability of the present invention to anchor lines of various diameters may best be appreciated by reference to FIG. 12. Because of the arcuate surface 42 of the flapper wedge plate 26, more than an edge contact will be achieved between the plate 26 and the various diameter anchor lines designated by the reference characters $L_a$, $L_b$ and $L_c$. That is to say, regardless of the diameter of the anchor line L, the plate 26 will engage the anchor line over a large surface area thereof. When the anchor line L is of relatively large diameter, it will be necessary to pivot the plate 26 upwardly to an extreme position within the closed body 14. In order to avoid interference between the plate 26 and the remainder of the body portion 14, it has been found convenient to provide recesses 72 at the side edges of the plate 26 so the same may pivot upward within the body unrestricted and to the fullest possible extent thereby enabling the accommodation of lines L of the largest diameter within the body 14.

While there have been shown and described and pointed out the fundamental novel features of the invention as applied to preferred embodiments thereof, it will be understood that various omissions and substitutions in the form and details of the device illustrated and its operation may be made by those skilled in the art without departing from the spirit of the invention. It is the intention, therefore, to be limited only as indicated by the scope of the claims appended hereto.

What is claimed is:

1. An anchor float adapter comprising:

an elongate body having a uniformly hollow interior portion having first and second sections pivotally connected to each other to open and close an opening defined in the side therein and extending fully along said elongate body such that said anchor float adapter may be readily placed about and removed from an anchor line at said side opening, said adapter being freely movable in a first direction towards an anchor along the anchor line when said anchor float adapter is mounted on the anchor line and the anchor line is slack;

tabs on one of said sections extending outward of said hollow interior portion;

clamp means coupled to said tabs and extending into said hollow portion for clamping said anchor float adapter against movement relative to the anchor line opposite to said first direction along the length of the anchor line;

float means coupled to said body portion such that said anchor float adapter is buoyantly supported in a body of water whereby said adapter moves along the anchor line in said first direction and is ultimately clamped at a location adjacent the anchor by said clamping means thereby permitting the anchor to be easily lifted by said float means; and releasable means to retain said first and second sections closed and operable to release the same such that the same may pivot to open said opening.

2. An anchor float adapter according to claim 1 wherein hinge means are provided for coupling said first and said second sections of said body portion to each other whereby said body opening may be opened and closed along its entire length to thereby facilitate placement and removal thereof with respect to an anchor line.

3. An anchor float adapter according to claim 1 wherein said clamp means comprises a plate that is pivotally mounted proximate one end thereof to said body portion whereby when an anchor line is within the hollow of said anchor float adapter, the opposite end of said plate will engage the anchor line.

4. An anchor float adapter according to claim 3 wherein said opposite end of said plate rides freely over an anchor line when said adapter moves in said first direction and wedges against an anchor line in said adapter to prevent said adapter from moving in a direction opposite said first direction.

5. An anchor float adapter according to claim 4 wherein said opposite end of said plate is concave.

6. An anchor float adapter according to claim 5 wherein the side edges of said plate that are intermediate said first and said opposite ends thereof are recessed in order to permit maximum deflection of said plate within said body portion whereby anchor lines of different sizes may be accommodated in said body portion.

7. An anchor float adapter according to claim 1 wherein said releasable means comprises a slotted plate secured to one of said sections of said body portion, an eye secured to the other one of said sections of said body portion with said eye being arranged to pass through said slotted plate when said body portion is positioned about the anchor line, and a hairpin-type clip passing through said eye when said eye is in said slot to thereby prevent the inadvertent separation of said plate and said eye.

8. An anchor float adapter according to claim 1 wherein said releasable means comprises interdigitated loops formed integrally on adjacent longitudinal edges of said first and said second sections of said body portion, and a generally U-shaped spring clip having one leg thereof extending through said loops when said loops are aligned, the free end of one of the legs of said U-shaped clip having means for releasably engaging the free end of the other leg of said U-shaped clip.

9. The method of raising an anchor attached to a boat by an anchor line in which an adapter has an elongated tubular member with an elongated linear opening in the side thereof opening into a uniformly hollow interior, said method comprising:

when it is desired to raise the anchor, exposing the elongated opening and applying the adapter to the anchor line by inserting the anchor line into the interior of the elongated tubular member through the elongated linear opening in the side of the same and closing the opening to prevent the accidental removal of the anchor line from the tubular member;

floating the tubular member to cause the same to rise in water by applying a buoyant force to it to cause the same to move in a direction along the anchor line toward the anchor as the anchor line becomes slack;

clamping the tubular member and anchor line to each other to prevent reverse relative movement therebetween when the anchor line loses its slack;

moving the boat with respect to the anchor attached to the boat by the anchor line thereby causing the anchor to turn in its anchorage and to release its hook from the bottom of the water and causing at least a portion of the anchor line to become slack and to rise upwardly in the water because of the buoyant force applied to it; and removing the tubular member from the anchor line when the anchor line and anchor have risen to a desired extent by exposing the uniformly hollow interior of the tubular member and withdrawing the anchor line from the tubular member through the linear opening.

10. A method according to claim 9 wherein the anchor line is initially secured to the bow of the boat and including the further step of transferring the anchor line to the stern of the boat before the step of moving the boat an angle with respect to the anchored portion of the anchor.

11. A method according to claim 9 wherein said step of moving the boat comprises the step of causing the boat to travel at approximately an angle of 45° with respect to the anchored position of the anchor.

12. An anchor float adapter for positioning about and removal from an anchor line comprising:

an elongate body having an essentially uniformly hollow interior along the length thereof and a linear opening defined in the elongate wall thereof through which an anchor line may pass as a unit for insertion into the hollow interior of said body and for removal therefrom;

a section operable on said body to open said opening for the insertion of an anchor line into the interior of said body and operable to close said opening to prevent the removal of an anchor line from said body interior;

tabs on said body outward of said hollow interior; and engaging means on said tabs and extending into said hollow interior for engaging an anchor line therein to prevent relative movement of the anchor line and said body in one direction and to permit relative movement thereof in another direction.

13. An anchor float adapter as in claim 12, means on said body to which a float is removably connectible to buoyantly lift said body in water.

14. An anchor float adapter as in claim 13, said section being pivoted on said body for movement relative to said opening to open and close the same, and releasably cooperating with said section and body to retain said section to close said opening and releasable to leave said opening open and unrestricted.

15. An anchor float adapter as in claim 14, said engaging means being a plate pivotted on said tabs and extending into the interior thereof and having an engaging edge formed concave and the extent of said plate being concave with the sides of said plate remote from said edge being recessed to enable said plate to pivot substantially unobstructed within said body.

* * * * *